United States Patent [19]

Wilson et al.

[11] Patent Number: 4,496,643

[45] Date of Patent: Jan. 29, 1985

[54] TWO-COMPONENT DRY ELECTROSTATIC DEVELOPER COMPOSITION CONTAINING ONIUM CHARGE CONTROL AGENT

[75] Inventors: John C. Wilson, Rochester; Lawrence P. DeMejo, Pittsford; Thomas A. Jadwin; Stewart H. Merrill, both of Rochester, all of N.Y.

[73] Assignee: Eastman Kodak Company, Rochester, N.Y.

[21] Appl. No.: 592,996

[22] Filed: Mar. 23, 1984

[51] Int. Cl.[3] ..... G03G 9/10

[52] U.S. Cl. ..... 430/110; 430/115

[58] Field of Search ..... 430/110, 115

[56] References Cited

U.S. PATENT DOCUMENTS 3,893,935 7/1975 Jadwin et al. .

3,970,571 7/1976 Olson ..... 430/110 X

*Primary Examiner*—John D. Welsh

*Attorney, Agent, or Firm*—Torger N. Dahl

[57] ABSTRACT

A two-component, dry electrostatic developer composition containing toner particles and coated-carrier particles is disclosed. The toner contains a binder polymer and a phosphonium, arsonium or stibonium charge-control agent dispersed in the toner binder. The carrier is coated with a fluoropolymer. The resulting developer exhibits reduced toner throw-off and other disclosed advantages.

9 Claims, No Drawings

TWO-COMPONENT DRY ELECTROSTATIC DEVELOPER COMPOSITION CONTAINING ONIUM CHARGE CONTROL AGENT

The present invention relates to a two-component dry, electrostatic developer composition comprising coated carrier particles and toner particles, the latter comprising a blend of a polymeric binder and a charge-control agent.

In the art of electrostatography, image patterns of electrostatic charge are formed on an insulating surface by a variety of well-known methods. For example, by photoconductive methods electrostatic charge is caused to dissipate imagewise from the surface of a photoconductive layer toward an electrode or grounding layer by the action of actinic radiation. The resulting electrostatic charge pattern is subsequently developed—or transferred to another element and developed—by contact with a developer composition.

A commonly employed developer composition comprises a dry, two-component blend of toner particles and carrier particles. The particles in such compositions are formulated so that the toner particles acquire a charge of one polarity and the carrier particles acquire a charge of opposite polarity by triboelectrification. This can be accomplished, for example, when (a) the toner particles contain a charge-control agent, along with a toner resin, and (b) the surface of the carrier particles is coated with an appropriate polymer.

A particularly useful class of charge-control agents comprises certain quaternary ammoniun salts as described in Jadwin et al U.S. Pat. No. 3,893,935. The ammonium salts of U.S. Pat. No. 3,893,935 exhibit relatively high, uniform and stable net toner charge (when intermixed with a suitable carrier) and exhibit a minimum amount of deleterious toner throw-off, as defined below. However, in part due to the thermal instability of ammonium salts during melt compounding, it has become desirable to provide other useful charge-control agents, particularly onium salt compounds.

U.S. Pat. No. 3,893,935 also describes compositions containing other types of onium salts such as sulfonium and phosphonium salts. Unfortunately, such onium salts are described as having substantially poorer charge-control properties compared with the ammonium agents, as demonstrated by their inferior toner throw-off characteristics in a simulated copy process, despite reasonably high net toner charge.

It is an object of the present invention, therefore, to provide a dry, two-component electrostatic developer composition which exhibits reduced toner throw-off and other desirable properties. This object is achieved with the combination of (1) toner particles comprising a polymeric binder and, as a charge-control agent, an onium compound having the formula:

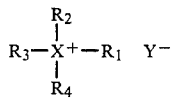

I wherein:

X is a phosphorous, arsenic or antimony atom;

each of $R_2$, $R_3$ and $R_4$, which are the same or different, represents alkyl having from 1 to about 20 carbon atoms; aralkyl or alkaryl in which the alkyl group has 1 to about 20 carbon atoms and the aryl group has from about 6 to about 12 carbon atoms; or aryl having from about 6 to about 12 carbon atoms;

$R_1$ is a group as defined with respect to $R_2$, $R_3$ and $R_4$; a hetero ring system when taken together with X and any one of $R_2$, $R_3$ and $R_4$; or the group:

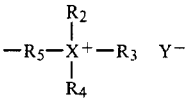

II wherein $R_5$ is alkylene having from about 1 to about 20 carbon atoms, oxydialkylene having from about 1 to about 20 carbon atoms in each alkylene group or dialkylenearylene having from about 1 to about 20 carbon atoms in each alkylene group and from about 6 to about 14 atoms in the arylene group, and $Y^-$ is an anion, and (2) carrier particles surface-coated with a fluoropolymer.

Each of the $R_1$, $R_2$, $R_3$ and $R_4$ groups above, moreover, can be further substituted with one or more substituents which do not impair the ability of the resulting onium salt to function as a charge-control agent for the developer composition of the invention. Representative substituents include hydroxy, alkoxy, carboxy, alkoxycarbonyl, alkylcarbonyloxy, halo, and hetero atom-containing groups.

Preferred onium charge-control agents are those in which three of the above-defined substituents on the X atom are either aryl (optionally substituted), such as phenyl, or 2- to 5-carbon alkyl (optionally substituted). In addition, a variety of conventional anions can be utilized for $Y^-$, including the following: halides such as chloride, bromide, or iodide; tetrafluoroborate; hexafluorophosphate; acetate; p-toluenesulfonate; carboxylate; benzoate; trimellitate; phosphomolybdate; benzensulfonate; dimethylbenzenesulfonate; trifluoromethanesulfonate; thiocyanate; tetraphenylborate; perchlorate and nitrate.

The combination of (a) the above onium salt charge-control agent dispersed in the toner binder and (b) a fluoropolymer coating on the carrier particles has been found particularly effective in reducing toner throw-off. In addition, the onium salt charge-control agents have been found to have no deleterious effect on the adhesion properties of the resultant toner particles to conventional paper receiving sheets. Furthermore, the onium salts are advantageously colorless, transparent and odorless, and toners containing them are substantially resistant to cracking when fused to paper supports.

Representative onium salts for use in the invention are the following:

TABLE 1

| Compound | |
|---|---|
| 1 | benzyltriphenylphosphonium chloride; |
| 2 | methyltriphenylphosphonium bromide; |
| 3 | tetrabutylphosphonium bromide; |
| 4 | dodecyltributylphosphonium bromide; |
| 5 | phthalimidomethyltributylphosphonium bromide; |
| 6 | octadecyltributylphosphonium bromide; |
| 7 | methyltriphenylphosphonium fluoroborate, |
| 8 | ethyltriphenylphosphonium fluoroborate; |
| 9 | methyltriphenylphosphonium hexafluorophosphate; |
| 10 | dodecyltributylphosphonium p-toluenesulfonate; |
| 11 | bis(4-carbomethoxyphenyl)methylphenylphospho- |

TABLE 1-continued

| Compound | |
|---|---|
| | nium p-toluenesulfonate; |
| 12 | bis(4-hydroxypropyl)methylphenylphosphonium p-toluenesulfonate; |
| 13 | bis(4-acetoxyphenyl)methylphenylphosphonium p-toluenesulfonate; |
| 14 | tris(4-acetoxyphenyl)methylphosphonium p-toluenesulfonate; |
| 15 | methyltriphenylphosphonium p-toluenesulfonate; |
| 16 | dodecyltriphenylphosphonium p-toluenesulfonate; |
| 17 | methyltriphenylphosphonium benzenesulfonate; |
| 18 | ethyltriphenylphosphonium p-toluenesulfonate; |
| 19 | phenethyltriphenylphosphonium p-toluenesulfonate; |
| 20 | ethylene-bis(triphenylphosphonium p-toluenesulfonate); |
| 21 | methyltriphenylphosphonium tetraphenylborate; |
| 22 | tris(methoxyphenyl)methylphosphonium p-toluenesulfonate; |
| 23 | methyltritolylphosphonium p-toluenesulfonate; |
| 24 | tris(chlorophenyl)methylphosphonium p-toluenesulfonate; |
| 25 | tris(carbomethoxyphenyl)methylphosphonium p-toluenesulfonate; |
| 26 | benzyltriphenylphosphonium phosphomolybdate; |
| 27 | benzyltriphenylphosphonium silicotungstate; |
| 28 | methyltriphenylphosphonium phosphomolybdate; |
| 29 | benzyltriphenylphosphonium phosphotungstate; |
| 30 | methyl 4-carbomethoxyphenyldiphenylphosphonium p-toluenesulfonate; |
| 31 | methyl 4-acetoxyphenyldiphenylphosphonium p-toluenesulfonate; |
| 32 | methyl 3,5-biscarbomethoxyphenyldiphenylphosphonium p-toluenesulfonate; |
| 33 | (m + p)vinylbenzyltriphenylphosphonium p-toluenesulfonate; |
| 34 | methyltriphenylarsonium p-toluenesulfonate; |
| 35 | methyltriphenylantimonium p-toluenesulfonate |

The polymeric toner resins useful in the practice of the present invention can be used alone or in combination with other resins conventionally used in electrostatic toners. In this regard, blends of resins are often desirable to obtain optimum fusing, compounding and grinding properties. Useful amorphous resins generally have a glass transition temperature within the range from about 60° to 120° C. The melting point of useful crystalline resins preferably is within the range of from about 65° to about 200° C. Toner particles with such resins or blends of resins can readily be fused to conventional paper receiving sheets to form a permanent image.

Among the various resins which may be employed in the toner particles are polyacrylic and polystyrene resins, polycarbonates, rosin-modified maleic alkyd resins, polyamides, phenol-formaldehyde resins and polyester resins. Especially useful are crosslinked polymers of styrene such as crosslinked copolymers derived from styrene or lower alkyl styrene and an acrylic monomer such as an alkyl acrylate or methacrylate.

The toner particles employed in the developer of the present invention can be prepared by a variety of methods including spray-drying or melt-blending. When melt-blending is employed, the phosphonium charge-control agents are preferably used.

Melt-blending involves melting a powdered form of the toner polymer and mixing it with suitable colorants, if desired, and the charge-control agent of choice. The resin can readily be melted on heated compounding rolls which are also useful in blending the resin and addenda so as to promote the complete intermixing of the various components, and particularly to render the charge-control agent and the resin compatible, as described below. After thoroughly blending, the mixture is cooled and solidified. The resultant solid mass is then broken into small particles and finely ground to form a free-flowing powder of toner particles. These particles have an average particle size within the range of from about 0.1 to about 100 micrometers. In general, the concentration range in which the charge-control agent provides preferred results ranges from about 0.5 to about 5.0 parts by weight charge agent per 100 parts by weight toner resin.

The toner particles described above are mixed with carrier particles to form the developer composition of the present invention. The carrier particles which can be used with the present toners can be selected from a variety of materials. Suitable carrier particles include nonmagnetic particles such as glass beads, crystals of inorganic salts such as sodium or potassium chloride, hard resin particles, and metal particles. Preferably, magnetic particles are employed, as the problem of toner throwoff is especially pronounced in magnetic brush development processes. Suitable magnetic carrier particles include ferromagnetic materials such as iron, cobalt, nickel and alloys, and mixtures thereof. Particularly useful magnetic particles include hard (i.e., permanent) magnetic particles having a coercivity of at least 100 gauss at magnetic saturation such as described in copending U.S. patent application Ser. No. 548,807 entitled TWO-COMPONENT, DRY ELECTROGRAPHIC DEVELOPER COMPOSITIONS CONTAINING HARD MAGNETIC CARRIER PARTICLES AND METHODS FOR USING THE SAME, filed Nov. 4, 1983, in the names of E. T. Miskinis and T. A. Jadwin, the disclosure of which is incorporated herewith by reference. Such hard magnetic particles include ferrites and gamma ferric oxide. Preferably, the carrier particles are composed of ferrites, which are compounds of magnetic oxides containing iron as a major metallic component. Ferrites also include most preferably compounds of barium and/or strontium, such as $BaFe_{12}O_{19}$ and the magnetic ferrites having the formula $MO.6Fe_2O_3$, where M is barium, strontium or lead, as disclosed in U.S. Pat. No. 3,716,630.

As previously noted, the carrier particles employed in the developer of the present invention are coated with a fluoropolymer. In this regard, it is believed that the fluoropolymer coating on the carrier interacts with the onium charge-control agent in the toner to impart high net charge to the toner and provide low throw-off characteristics.

Suitable fluoropolymers which can be employed to coat the carrier include fluorocarbon polymers such as perfluoro-alkoxy fluoropolymers, poly(tetrafluoroethylene), poly(vinylidene fluoride), poly(vinylidene fluoride-co-tetrafluoroethylene), polyvinyl fluoride, and poly(hexafluoropropylene-tetrafluoroethylene).

The carrier particles can be coated with a tribocharging fluorocarbon resin by a variety of techniques such as solvent coating, spray application, plating, tumbling or melt coating. In melt coating, a dry mixture of carrier particles with a small amount of powdered fluorocarbon resin, e.g., 0.05 to 5.0 weight percent resin, based on the weight of carrier is formed, and the mixture heated to fuse the resin. Such a low concentration of resin will form a thin layer of resin on the carrier particles.

The developer is formed by mixing the carrier particles with toner particles in a suitable concentration. The present developer contains up to about 50 percent toner, by weight of developer. Preferably, the developer contains from about 70 to 99 weight percent carrier and about 30 to 1 weight percent toner. Most preferably, the concentration of carrier is from about 75 to 99 weight percent and the concentration of toner is from about 25 to 1 weight percent.

The effective charge of the developer of the present invention is, by convention, referred to by the level and polarity of charge on the toner component, inasmuch as the overall charge of the developer will tend toward neutral in view of the opposite and equal charge of the toner and the carrier. The polarity of the developer charge is preferably positive. The level of charge on the developer is preferably in the range from about 9 to about 35 microcoulombs per gram of toner in the developer as determined in accordance with the procedure described in greater detail below.

The following examples are provided to aid in the understanding of the invention. In these examples, values for developer charge level and toner throw-off are reported. The developer charge level, in units of microcoulombs per gram of toner in the developer, was determined by plating the toner by electrical bias onto the electrically insulating layer of a test element. This element was composed of, in sequence, a film support, an electrically conducting (ie, ground) layer and the insulating layer. The amount of plating was controlled to produce a mid-range reflection optical density (OD). For purposes of the present invention, toner was plated to an OD of about 0.3. The test element containing the plated toner was connected via the ground layer to an electrometer. The plated toner was then rapidly removed in a current of forced air, causing a flow of current to register in the electrometer as a charge, is microcoulombs. The registered charge was divided by the weight of the plated toner to obtain the toner charge.

Toner throw-off was determined in the following manner: A fixed quantity of a well-mixed developer (ie, mixture of toner and carrier particles) is measured and placed in an open cup positioned in a device oscillating laterally through a 0.75-inch (1.9-cm) distance at 8 cycles per second for a 10-minute interval. The toner throw-off of the developer mix due to the oscillation is collected on filter paper spaced 0.2 inch (0.5 cm) from the surface of the sample cup. The filter paper is subjected to a 9-mm Hg (9-Torrs) vacuum and, after the test, weighed and reported in milligrams.

PREPARATION 1

Methyltriphenylphosphonium tetrafluoroborate

In a vessel containing 600 ml of water were dissolved 143 g (0.4 mole) of methyltriphenylphosphonium bromide with stirring. In a separate vessel, 50 g (0.4 mole) of sodium fluoroborate (98% pure) were dissolved in 600 ml of water at 40° C. The latter solution was filtered to remove insolubles and added in a steady stream over about 20 minutes to the stirred phosphonium salt. The product precipitated. When cooled to room temperature, the product was collected and washed with two 50-ml portions of water. The salt was air-dried at 50° C. to give a product having a melting point of 125°–126° C.

PREPARATION 2

Methyltriphenylphosphonium p-toluenesulfonate

A mixture of 65.57 g (0.25 mol) of triphenylphosphine and 46.56 g (0.25 mol) of methyl p-toluenesulfonate was heated under nitrogen with stirring in a 130°-C. bath for 1 hr. On cooling, a clear, colorless amorphous glass resulted.

PREPARATION 3

Bis(p-carbomethoxyphenyl)phenylmethylphosphonium p-toluene sulfonate

This compound was prepared by quaternization of bis(p-carbomethoxyphenyl)phenylphosphine (I) with methyl p-toluenesulfonate (II) in the melt phase. A mixture of 18.92 g (0.05 mol) of I and 9.31 g (0.05 mol) of II was heated in a 130°-C. bath for 1 hr with stirring. The viscous material was cooled to an amorphous glass which was hygroscopic.

Analysis: Calculated for $C_{30}H_{29}O_7PS$: C, 63.8; H, 5.2; P, 5.5; S, 5.7. Found: C, 62.9; H, 5.2; P, 5.5; S, 5.7.

PREPARATION 4

Methyltriphenylarsonium p-toluenesulfonate

A mixture of 50.0 g (0.1632 mol) of triphenylarsine and 30.4 g (0.1632 mol) of methyl p-toluenesulfonate was heated in a 125°–145° C. bath under nitrogen with stirring for 1 hr and cooled. The glassy solid was crystallized by treatment with ether, collected and dried.

The melting point of the resulting product was 136°–141° C. and the product was confirmed by NMR.

PREPARATION 5

Methyltriphenylstibonium p-toluenesulfonate

A mixture of 17.65 g (0.05 mol) of triphenylstibine and 9.31 g (0.05 mol) of methyl p-toluenesulfonate was heated in a 130° C. bath with nitrogen bubbling through the melt for 18 hr. The resulting syrup was cooled to an amorphous glass which was crystallized by treatment with ether. The resultant crystals were collected and dried.

The melting point of the resulting product was 149°–152° C. and the product was confirmed by NMR.

EXAMPLE 1

This example illustrates the use of the developer of the present invention and to the advantages of low toner throw-off and low toner crack-width.

A phosphonium charge-agent from Table 1 was added as a 5%, by weight, solution in methylene chloride to a a polyester binder. This polyester was poly(2,2'-oxydiethylene-co-neopentylene-co-pentaerythrityl terephthalate). Each resulting toner formulation was formulated with 1 part per hundred charge agent and 6 parts per hundred Regal 300 pigment (a trademark for a carbon black pigment sold by Cabot Corporation). The addenda were heated on a two-roll rubber mill, cooled, and ground to a toner particle size of from 2–40 micrometers in a fluid energy mill.

The carrier employed to form the developer comprised an oxidized sponge iron powder coated with poly(vinylidene fluoride).

The toner and carrier were mixed in a closed container by rotating the latter on a two-roll mill several minutes to provide a toner concentration of from 3 to 4% by weight of the developer.

Electrophotographic images were formed with these developers and fused on a bond paper support at 300° F. (149° C.), 18 pounds per linear inch, with the fusing rollers moving at 14.5 inches (36.8 cm) per second. The crack width range of fused toners was measured in micrometers.

TABLE 2

| Charge Agent of Table 1 | Crack Width (μm) | Charge/Mass (μ coulombs/g) | Toner Throw-Off (mg) |
|---|---|---|---|
| Ammonyx 4002 TM | >200 | +19.8 | 0.4 |
| None (control) | 50–200 | +13.3 | 4.9 |
| 1 | 50–100 | +27.2 | 0.5 |
| 2 | 50–200 | +23.1 | 0.6 |
| 5 | 50–200 | +26.2 | 1.0 |
| 7 | 50–100 | +22.5 | 0.6 |
| 9 | 50–100 | +25.6 | 1.1 |
| 15 | | +28.9 | 0.2 |
| 16 | | +26.8 | 0.0 |
| 17 | | +25.9 | 0.0 |
| 18 | | +27.8 | 0.1 |
| 19 | | +27.2 | 1.0 |
| 20 | | +27.8 | 0.3 |
| 34 | | +24.6 | 0.6 |
| 35 | | +27.6 | 0.7 |

As evidenced in Table 2, the developers of this invention exhibit lower toner throw-off compared with the control. The developer toner crack resistance, moreover, was improved (i.e. exhibited lower crack width) compared with an otherwise identical composition containing the commercially available charge agent, benzyloctadecyldimethylammonium chloride (Ammonyx 4002 TM).

EXAMPLE 2

This example illustrates a developer of the present invention in which the binder polymer of the toner is an acrylic copolymer. In particular, the developer was evaluated for crack resistance at varying temperatures of fusion.

The toner was formulated with poly(styrene-co-butyl acrylate-co-divinylbenzene) as the binder polymer, 2 parts per hundred of the charge-control agent described in Preparation 2 above, and 6 parts per hundred of Regal 300 carbon black pigment. After formulation with a carrier into a developer, the toner was used to develop a latent image and fused at temperatures ranging from 330° to 350° F. (166° to 177° C.). The crack width of the toner image was measured and determined to range from about 115 micrometers at the lower temperature to about 40 micrometers at the higher temperature.

EXAMPLE 3

In this example, a developer of the present invention is compared with a developer of the prior art as disclosed in U.S. Pat. No. 3,893,935.

U.S. Pat. No. 3,893,935 discloses a toner containing tetrabutylphosphonium bromide as a charge-control agent in combination with a magnetically responsive carrier coated with a terpolymer of acrylonitrile, vinylidene chloride and acrylic acid.

To illustrate the importance of the type of coating on the carrier, namely, a fluoropolymer coating, the following evaluations were conducted:

The toners employed contained the same binder and pigment as in Example 1. Two toner formulations were prepared. In the first, toner A, the charge-control agent was tetrabutylphosphonium bromide in a weight ratio of 30/0.45/1.8 binder/charge-control agent/pigment. In the second, toner B, the charge-control agent was methyltriphenylphosphonium fluoroborate in a weight ratio of 50/0.75/3.0 binder/charge-control agent/pigment.

The carriers employed with each of these toners were as follows:

Carrier C: An uncoated, magnetized, strontium ferrite powder.

Carrier D: Carrier C coated with 1.0 part per hundred Kynar 301 TM (a polyvinylidene fluoride fluoropolymer available from Pennwalt Corp.).

Carrier E: Carrier C solvent-coated with 1.0 part per hundred of a terpolymer of acrylonitrile (14 mole percent), vinylidene chloride (80 mole percent) and acrylic acid (6 mole percent).

All developers evaluated contained 10 weight percent carrier and the balance toner. Various combinations of toner and carrier were evaluated for toner charge and toner throw-off in accordance with the procedures defined earlier herein. Result are listed in Table 3 below:

TABLE 3

| Developer Toner/Carrier | Toner Charge (μ coul/g) | Throw-off (mg) |
|---|---|---|
| A/C | too low | 45.7 |
| A/D (Invention) | 9.6 | 1.6 |
| A/E (prior art) | 5.8 | 3.3 |
| B/C | too low | 56.6 |
| B/D (Invention) | 9.8 | 0.9 |
| B/E (Prior Art) | 5.5 | 3.1 |

As shown in Table 3, when onium charge-control agents as described herein are employed with fluoropolymer coated carriers, toner toner throw-off is significantly reduced to a level acceptable in copier applications.

Although the invention has been described in considerable detail with particular reference to certain preferred embodiments thereof, variations and modifications can be effected within the spirit and scope of the invention.

What is claimed is:

1. A dry, two-component electrostatic developer composition comprising:

(a) toner particles comprising a polymeric binder, (b) an onium compound, as a charge-control agent, dispersed in the toner binder and having the formula:

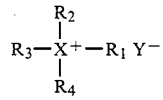

wherein:

X is a phosphorous, arsenic or antimony atom;

each of $R_2$, $R_3$ and $R_4$, which are the same or different, represents alkyl having from 1 to about 20 carbon atoms; aralkyl or alkaryl in which the alkyl group has 1 to about 20 carbon atoms and the aryl group has from about 6 to about 14 carbon atoms; or aryl having from about 6 to about 14 carbon atoms;

$R_1$ represents a group as defined with respect to $R_2$, $R_3$ and $R_4$; a hetero ring system when taken together with X and any one of $R_2$, $R_3$ and $R_4$; or the group:

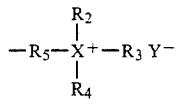

wherein:

$R_5$ is alkylene having from about 1 to about 20 carbon atoms; oxydialkylene having from about 1 to about 20 carbon atoms in each alkylene group or dialkylenearylene having from about 1 to about 20 carbon atoms in each alkylene group and from about 6 to about 14 atoms in the arylene group; and $Y^-$ is an anion, and (c) carrier particles surface-coated with a fluoropolymer.

2. The developer of claim 1 wherein each of $R_2$, $R_3$ and $R_4$ is optionally substituted aryl, or optionally substituted 2- to 5-carbon alkyl.

3. The developer of claim 1 wherein the fluoropolymer coating on the carrier is a polymer selected from the group consisting of perfluoroalkoxy fluoropolymers, poly(tetrafluoroethylene), poly(vinylidene fluoride), poly(vinylidene fluoride-co-tetrafluoroethylene), polyvinyl fluoride, and poly(hexafluoropropylene-tetrafluoroethylene).

4. A developer as in claim 1 wherein the charge-control agent is selected from the group consisting of:

1 benzyltriphenylphosphonium chloride;
2 methyltriphenylphosphonium bromide;
3 tetrabutylphosphonium bromide;
4 dodecyltributylphosphonium bromide;
5 phthalimidomethyltributylphosphonium bromide;
6 octadecyltributylphosphonium bromide;
7 methyltriphenylphosphonium fluoroborate;
8 ethyltriphenylphosphonium fluoroborate;
9 methyltriphenylphosphonium hexafluorophosphate;
10 dodecyltributylphosphonium p-toluenesulfonate;
11 bis(4-carbomethoxyphenyl)methylphenylphosphonium p-toluenesulfonate;
12 bis(4-hydroxypropyl)methylphenylphosphonium p-toluenesulfonate;
13 bis(4-acetoxyphenyl)methylphenylphosphonium p-toluenesulfonate;
14 tris(4-acetoxyphenyl)methylphosphonium p-toluenesulfonate;
15 methyltriphenylphosphonium p-toluenesulfonate;
16 dodecyltriphenylphosphonium p-toluenesulfonate;
17 methyltriphenylphosphonium benzenesulfonate;
18 ethyltriphenylphosphonium p-toluenesulfonate;
19 phenethyltriphenylphosphonium p-toluenesulfonate;
20 ethylene-bis(triphenylphosphonium p-toluenesulfonate);
21 methyltriphenylphosphonium tetraphenylborate;
22 tris(methoxyphenyl)methylphosphonium p-toluenesulfonate;
23 methyltritolylphosphonium p-toluenesulfonate;
24 tris(chlorophenyl)methylphosphonium p-toluenesulfonate;
25 tris(carbomethoxyphenyl)methylphosphonium p-toluenesulfonate;
26 benzyltriphenylphosphonium phosphomolybdate;
27 benzyltriphenylphosphonium silicotungstate;
28 methyltriphenylphosphonium phosphomolybdate;
29 benzyltriphenylphosphonium phosphotungstate;
30 methyl 4-carbomethoxyphenyldiphenylphosphonium p-toluenesulfonate;
31 methyl 4-acetoxyphenyldiphenylphosphonium p-toluenesulfonate;
32 methyl 3,5-biscarbomethoxyphenyldiphenylphosphonium p-toluenesulfonate;
33 (m+p)vinylbenzyltriphenylphosphonium p-toluenesulfonate;
34 methyltriphenylarsonium p-toluenesulfonate; and
35 methyltriphenylantimonium p-toluenesulfonate.

5. The developer of claim 2 wherein said charge-control agent is methyltriphenylphosphonium tetrafluoroborate, methyltriphenylphosphonium p-toluenesulfonate, or bis(p-carbomethoxypheny)phenylmethylphosphonium p-toluene sulfonate.

6. The developer of claim 1, 2, 3, 4 or 5 wherein the carrier comprises a magnetic material.

7. The developer of claim 6 wherein the magnetic material is a hard magnetic material having a coercivity of at least 100 gauss at magnetic saturation.

8. The developer of claim 6 wherein the concentration of the charge-control agent is from about 0.5 to about 5.0 parts by weight charge-control agent per 100 parts by weight toner resin.

9. The developer of claim 6 wherein the charge of the developer is from about 9 to about 35 microcoulombs per gram of toner in the developer.

* * * * *